United States Patent [19]

Gruns

[11] Patent Number: 4,499,627

[45] Date of Patent: Feb. 19, 1985

[54] FLEXIBLE SURFACE CLEANING AND COATINGS APPLICATOR TOOL

[76] Inventor: James H. Gruns, 5080 Woodson Dr., Mission, Kans. 66202

[21] Appl. No.: 467,300

[22] Filed: Mar. 17, 1983

[51] Int. Cl.[3] ..... A46B 9/10

[52] U.S. Cl. ..... 15/210 R; 15/143 R; 15/160; 15/244 R

[58] Field of Search ..... 15/160, 166, 143 R, 15/144 R, 118, 244 R, 244 B, 244 C, 210 R, 220 R, 235, 209 R

[56] References Cited

U.S. PATENT DOCUMENTS 1,796,001 3/1931 Church ..... 15/143 R X 3,821,829 7/1974 Finnerty ..... 15/244 R 4,263,691 4/1981 Pakarnseree ..... 15/193 X

FOREIGN PATENT DOCUMENTS 304459 1/1929 United Kingdom ..... 15/143 R

*Primary Examiner*—Peter Feldman

[57] ABSTRACT

This invention is directed to a surface cleaning and coatings applicator tool having a flexible deformable and reformable metal core encapsulated in thin sheets of plastic. These materials of composition give this tool the ability to clean or coat hard to reach surfaces without scratching or marring surfaces adjacent to those being cleaned or coated.

1 Claim, 6 Drawing Figures

FLEXIBLE SURFACE CLEANING AND COATINGS APPLICATOR TOOL

This invention relates to band-held surface cleaning and coatings tools and more particularly to special tool for the cleaning and/or coating of parts or surfaces not easily accessible by the use of conventional devices or brushes usually employed for these tasks.

Realizing that a properly cleaned surface is a prerequisite to the proper application of surface coatings, such as paint or wax; one objective of this invention is to provide a surface cleaning tool that is of a deformable and reformable character to make it readily adaptable for access to difficult to clean places and shapes. Examples, being window check rails, pipes, downspouts, or heating radiators located very close to surfaces such as walls, ceilings or floors.

Similarly, another objective is to provide a hand-held coatings tool that can readily adapt for access to these same places without damaging the surfaces adjacent to those places being coated or cleaned. Prior art depicted in U.S. Pat. No. 2,604,651 shows a metal strip with a piece fiber affixed to one end. This device has limited usefulness as when applying coatings near varnished surfaces because the bare metal edges will scratch the varnish. Even if the metal strip edges were painted, that paint could abraid and eventually expose the burrs on the edges. Although, newer moulded plastic handled painting devices will not scratch adjacent surfaces, they are not of a deformable and reformable character and are not readily adaptable for access to difficult to reach surfaces. Therefore, another objective of this invention is to provide a cleaning and coatings tool having edges that will not mar or scratch surfaces adjacent to the surface being cleaned or coated.

Yet another object of this invention is to provide a cleaning and coatings tool having easily replaceable or cleanable fiberous material that does the cleaning or coatings application. Current, state of the art, flexible coating applicators either have permanently fixed fiberous material that require tedious cleaning to permit reuse or the applicator must be replaced altogether for each task.

Other objects and attendant advantages of this invention will become more readily apparent and understood from the following detailed specification and drawings wherein the like reference numerals denote corresponding parts throughout the several views.

Figure 2:
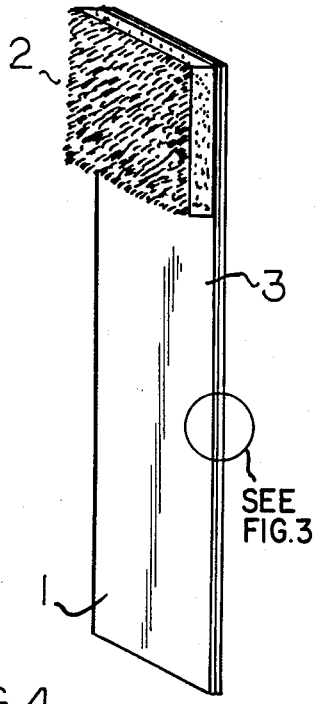
FIG. 2 is a closer perspective view of this invention.
Figure 3:
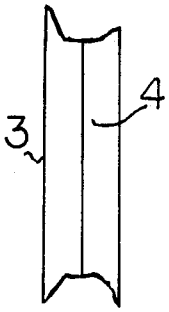
FIG. 3 is a detailed edge view of this invention showing the unique metal core with plastic encapsulation.
Figure 6:
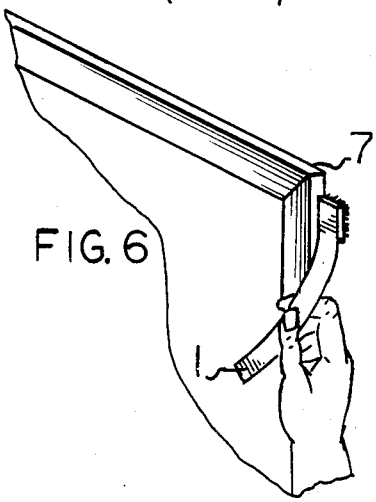
FIG. 6 is a perspective view of this invention when used near varnished surfaces.

Referring to FIG. 2 this invention is comprised of a pad 2 of fibrous, absorbent and/or adsorbent material affixed by adhesives to one end of the handle 1. A closer examination of the handle 1 in FIG. 3 shows a unique thin plastic 3 sheet that is laminated by a high temperature process to a thin, flat, core 4 in such a manner as to encapsulate the core 4. As shown, the metal core 4 is of unform cross-section for its entire length. The value of this plastic 3 encapsulation is shown in FIG. 5 and FIG. 6 where the adjacent surface 7 is not scratched by the plastic sheet 3 as the pad 2; laden with paint, for example, moves past the surface 7.

Figure 5:
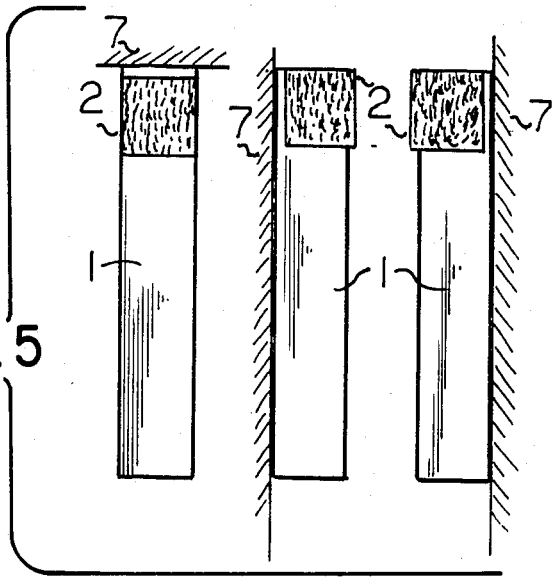
FIG. 5 is a series of elevational views showing this invention when used near adjacent surfaces.

FIG. 5 shows the preferred locations for the pad 2 on the handle 1 such that the pad 2 is offset so the handle 1 portion uncovered by the pad 2 can act as a guide to prevent excess paint to touch the adjacent surface 7 that is not to be painted, for example.

Figure 1:
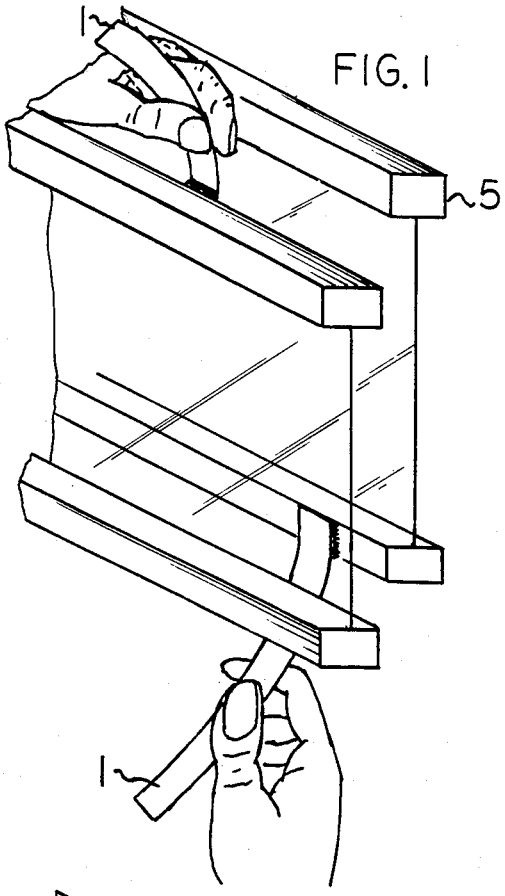
FIG. 1 is a perspective view of this invention when used to clean or apply coatings to hard to reach surfaces on a double hung window.

FIG. 1 shows the invention 1 being used to clean or apply surface coatings to hard to reach areas on a double hung window especially when the top window selction 5 is stuck or painted closed.

Figure 4:
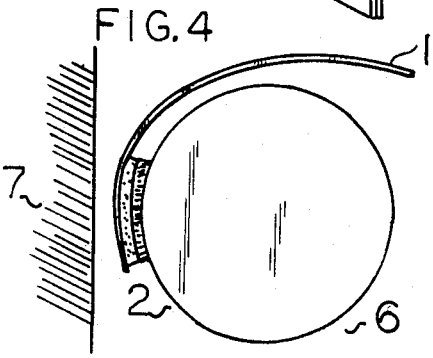
FIG. 4 is a plan view of this invention when applied to a pipe or downspout.

FIG. 4 shows this invention 1 used to clean or supply coatings on curved surfaces 6 located in hard to reach areas.

While the present invention has been described with reference to a preferred embodiment those familiar with this disclosure and skilled in the art may recognize additions, deletions, substitutions and other modifications, and equivalent which would fall within the purview of the invention as set forth in the appended claim.

The embodiment of the invention in which an exclusive property or privilege is claimed are defined as follows:

1. A surface preparation and coatings tool comprised of a handle assembly made of a deformable and reformable thin, flat metal core member encapsulated in a thin plastic sheathing material such that said handle retains a deformed shape when bent into said deformed shape, said core member being uniform in cross-section for its entire length;

said material completely encapsulates said core member through the application of an adhesive and/or sufficient heat so as to bond or fuse said plastic sheathing material to the core members in a manner that completely protects said core members from the corrosive effects of the chemicals contained in common surface preparation and/or surface coating compounds said plastic sheathing material protecting the surfaces adjacent the surfaces coated from being scratched or abraided by the metal core member;

said compounds being absorbed by a resilient, absorbent and/or adsorbent said absorbent member is mountable to and demountable from the handle assembly so as to be reuseable by affixing to said handle assembly a new and/or clean absorbent member;

said member is capable of releasing said compounds in a controlled manner; as the compound bearing absorbent member is placed with a sliding motion in contact with the surface to be prepared and/or coated.

* * * * *